United States Patent [19]

Yu

[11] Patent Number: 4,485,888

[45] Date of Patent: Dec. 4, 1984

[54] VEHICLE ENGINE COOLING APPARATUS

[75] Inventor: Mason K. Yu, Birmingham, Mich.

[73] Assignee: General Motors Corporation, Detroit, Mich.

[21] Appl. No.: 503,069

[22] Filed: Jun. 10, 1983

[51] Int. Cl.[3] ..... B60H 1/06; F01P 5/06

[52] U.S. Cl. ..... 180/297; 123/41.49; 123/41.66; 180/68.1; 180/68.4; 415/33; 416/53

[58] Field of Search ..... 123/41.11, 41.12, 41.49, 123/41.63, 41.65, 41.66; 416/51, 52, 53, 139; 180/54 A, 54 R, 68 R, 297; 415/33

[56] References Cited

U.S. PATENT DOCUMENTS

| | | | |
|---|---|---|---|
| 223,465 | 1/1880 | Barnes | 416/139 |
| 1,824,336 | 9/1931 | Michot-Dupont | 416/53 |
| 2,437,810 | 3/1948 | Earley et al. | 416/39 |
| 2,917,227 | 12/1959 | Ruegsegger | 416/139 |
| 3,217,808 | 11/1965 | Elmer | 416/53 |
| 3,219,122 | 11/1965 | Montgomerie et al. | 416/136 |
| 3,580,694 | 5/1971 | Virum | 416/136 |
| 3,763,835 | 10/1973 | Miller et al. | 123/41.11 |
| 4,090,812 | 5/1978 | Moran | 416/133 |
| 4,372,409 | 2/1983 | Mazur | 123/41.49 |

FOREIGN PATENT DOCUMENTS

| | | | |
|---|---|---|---|
| 782935 | 7/1935 | France | 416/53 |

*Primary Examiner*—William A. Cuchlinski, Jr.
*Attorney, Agent, or Firm*—Charles R. White

[57] ABSTRACT

Transversely mounted engine cooling fan in parallel with vehicle engine mechanically driven by straight drive and having blades whose pitch is varied in accordance with engine speed and load for optimized cooling performance. The fan has small radial dimension and extended width to match low and wide engine cooling radiator so that the front hood can be aerodynamically streamlined.

3 Claims, 7 Drawing Figures

VEHICLE ENGINE COOLING APPARATUS

This invention relates to vehicle engine cooling and more particularly to a transverse engine and cooling fan arrangement providing for low hood profile, straight mechanical fan drive from the engine and improved engine cooling efficiency.

Many vehicles with front wheel drive employ transversely mounted engines to provide increased space for the transmission, differential, front suspension struts and other components. Cooling of such transverse engines is generally accomplished with a forward mounted radiator and an electrically driven axial flow fan which eliminates requirement for right angle mechanical drive from the engine to the fan. While such axial flow fans and electric fan drives have met engine cooling requirements, new and improved fans and mechanical fan drive arrangements are desired.

To this end, the present invention employs a transverse (cage type) engine cooling fan which can be simply and directly mechanically driven from the engine by belt, chain or gear train to replace the electrically driven fan so that load on the vehicle electrical system is sharply reduced. The transverse fan of this invention has variable pitch blading and is positioned ahead of the radiator for more efficient cooling. This invention also allows improved streamlining of the vehicle with low hood lines since the air intake can be below the bumper and the fan has reduced diameter and increased width to match a low and wide radiator. The fan can be mounted downstream of the heat exchanger in a more conventional fashion if desired. In the preferred embodiment of this invention, the transverse fan has blading whose pitch is automatically varied in accordance with fan speed or with load conditions for an optimized air flow rate through the radiator to thereby provide improved cooling over a broad operating range.

The pitch of the fan blades is preferably centrifugally controlled by pendulum units which move outwardly in response to centrifugal force to simultaneously turn the blades of the fan to an infinite number of positions between a closed and a fully open position in accordance with fan speed. Maximum pitch and maximized air pumping of the fan is established at high operating engine speeds.

These and other features, objects and advantages of this invention will become more apparent from the following detailed description and drawing in which.

Figure 1:
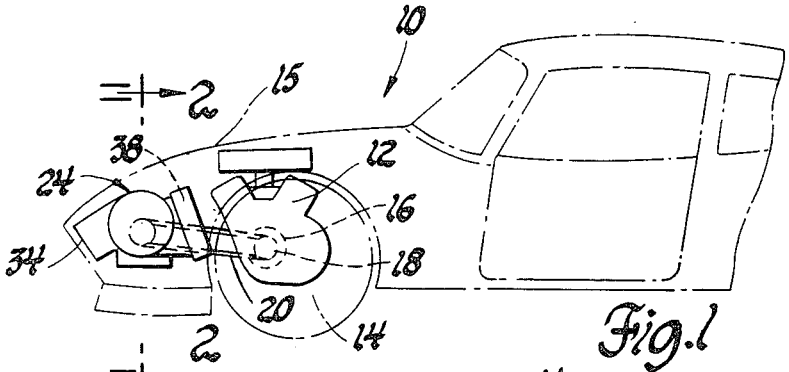
FIG. 1 is a side elevational view of a portion of a vehicle having an internal combustion engine and an associated engine cooling fan and radiator arrangement.
Figure 3:
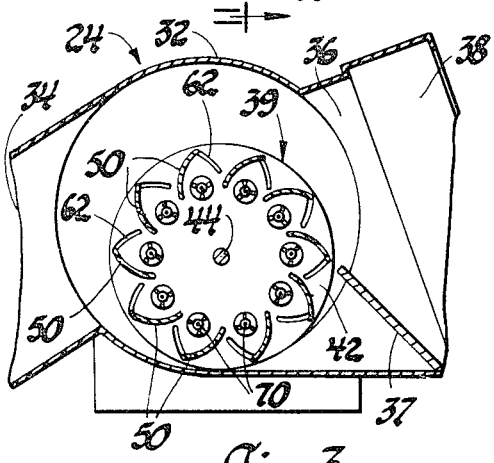
FIG. 3 is a view primarily in section of the transverse fan taken generally along lines 3—3 of FIG. 2.
Figure 2:
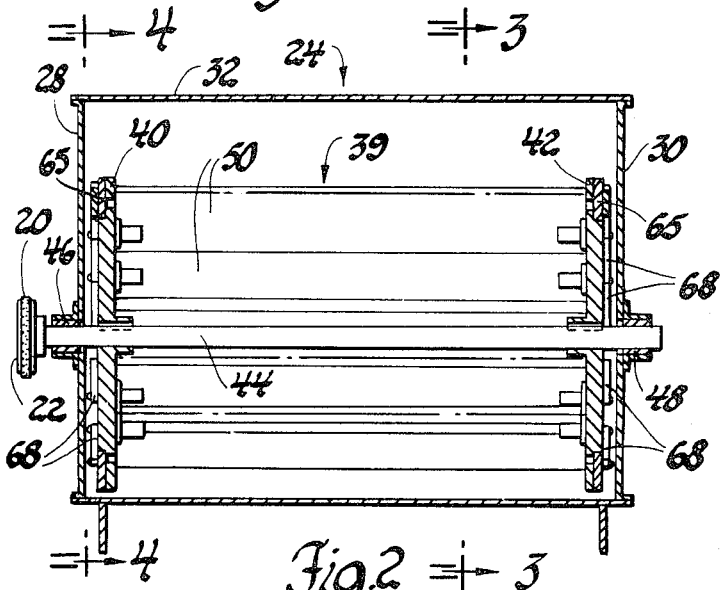
FIG. 2 is an enlarged view, partly in section, taken generally along lines 2—2 of FIG. 1 showing a bladed transverse fan assembly.
Figure 5:
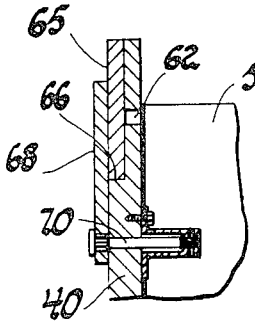
FIG. 5 is a cross-sectional view taken along lines 5—5 of FIG. 4.
Figure 6:
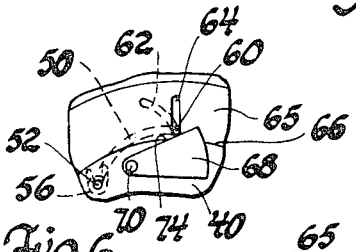
FIG. 6 is a fragmentary view of a portion of FIG. 4 showing fan components in a second position.
Figure 4:
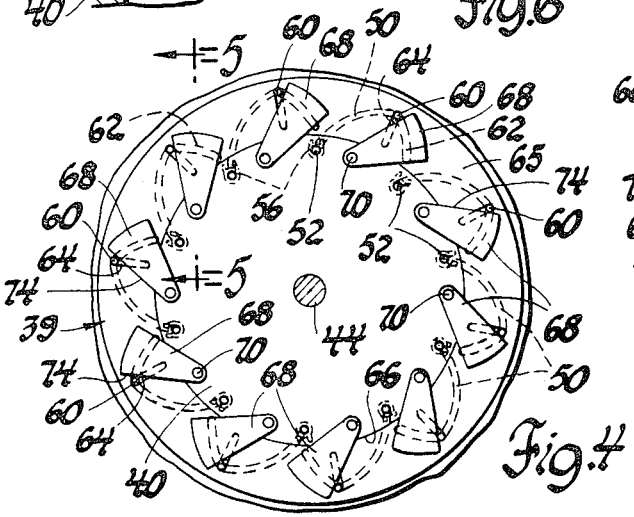
FIG. 4 is an end view taken generally along lines 4—4 of FIG. 2 showing fan components in a first position.
Figure 7:
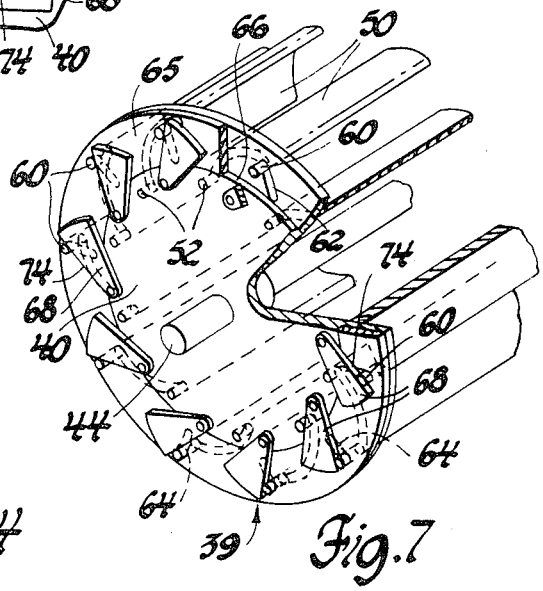
FIG. 7 is an isometric view of an end portion of the bladed fan assembly of FIGS. 2 and 4.

Turning now in greater detail to the drawings, there is shown in FIG. 1 a portion of an automobile 10 having an internal combustion engine 12 transversely mounted in a front engine compartment for driving front drive wheels 14. A hood 15 having a low and aerodynamically streamlined hood line for the vehicle provides a closure for the engine compartment. The engine crank has a conventional viscous clutch 16 mounted on the end thereof which operates to transmit torque when the temperature of the engine coolant exceeds a predetermined temperature to drive a pulley 18 mounted on the output side of the clutch. Pulley 18 drives an endless belt 20 that extends around and drives a drive pulley 22 of a transverse fan assembly 24 operatively mounted in the engine compartment forwardly of and in parallel relationship to the transverse mounted engine 12. The fan assembly 24 has an enlarged sheet metal housing mounted in the engine compartment with laterally spaced side walls 28 and 30 connected by a curved outer shell 32 and further has an air inlet opening 34 and an air discharge opening 36. A sheet metal inlet-outlet divider 37 extends laterally between the side walls to separate the inlet and outlet openings and thereby provide an optimized air path through the fan assembly. A radiator 38 through which engine coolant is circulated is mounted in the engine compartment adjacent to the discharge opening 36 so that the fan assembly can pump air therethrough to dissipate heat energy developed by the engine during engine operation. Operatively mounted within the sheet metal housing 26 is a bladed fan rotor 39. This rotor is formed as a generally cylindrical cage with annular side plates 40, 42 laterally spaced from one another and secured to a centralized drive shaft 44 extending laterally from drive connection with the pulley 22. The drive shaft 44 is journaled for rotation in the side walls 28, 30 by bearings 46, 48. In addition to the side plates 40, 42 the bladed fan rotor 39 further comprises a plurality of equally-spaced, variable-pitch blades or air foils 50 extending between the side plates 40, 42. These blades are preferably identical and each is pivoted to the side plates 40, 42 by aligned pivot pins 52 extending laterally outwardly from trailing end thereof. Suitable helical torsion springs 56 (FIG. 6) are mounted around each pivot pin 52 and have opposite ends connected to the associated side plate and to the blade respectively to yieldably bias the blades toward a closed position as will be further discussed below. The nose or forward end of said fan blade 50 has aligned and outwardly extending guide pins 60 which ride in arcuate slots 62 formed in the side plates 40, 42 as best shown in FIG. 6 which stabilize the blades as their pitch is varied and establishes the degree of maximum pitch. The guide pins 60 further project through radial slots 64 formed in a flat washer-like guide plate 65, mounted for limited turning movement on the annular shoulder portion 66 of the side plates 40, 42. With this guide plate construction the blades pivot in unison with guide plate turning so that each blade is identically pitched during fan operation.

As best shown in FIGS. 4–7, a plurality of small weights 68 are pivotally mounted by torsion bars 70 to the associated side plates 40 and 42. This torsional spring connection yieldably urges each associated weight 68 to an inboard position (FIG. 6) when there is no rotational drive of the fan assembly. Each of the weights has a camming surface 74 which engages the associated guide pin 60 on operation of this invention.

During engine operation and low engine coolant temperatures viscous clutch 16 has maximized slip so that blades 50 of the stationary or slowly rotating fan and the weights 68 are respectively biased by their associated springs toward their closed position. When engine coolant temperature increases, viscous clutch 16 fills with drive fluid and transmits torque for accelerating the fan rotor 39. Centrifugal forces pivot the weights 68 outwardly against the progressively increasing and yielding resistance of torsion bars 70 mounting weights 68 and of the springs acting on blades 50. This action varies the pitch of blades to a degree determined by the engine and fan speeds. As the blades progressively open, larger quantities of air are pumped from the inlet 34 through the discharge 36 and through the associated heat exchanger 38 so that the temperature of engine coolant is maintained in a recommended range. When coolant temperatures are reduced to a point at which the clutch disengages, the drive of the fan is interrupted and the radiator is primarily cooled by ram air.

In the preferred embodiment, the radiator has the height and width to match the fan which may extend laterally across the front of the vehicle. The cooling capacity of the radiator is high in view of its large area and its ability to be matched with the fan. The small radial dimension of the fan allows improved streamlining of the vehicle with small frontal areas and low front hood lines.

The blade setting of this invention can also be utilized to adjust fan performance to suit a specific job by properly setting the blade angularity and then securing the blades with a suitable locking device. In this manner, the performance of one fan can be optimized for several applications. Inlet and outlet blade angle, inner and outer diameter, blade camber line and speed are carefully selected in each case.

While a preferred embodiment of this invention has been shown and described to illustrate the invention, the scope of the invention is limited by the following claims.

The embodiments of the invention in which an exclusive property is claimed are defined as follows:

1. In an automotive vehicle, a vehicle body having a forward compartment, a hood for said compartment providing a low and streamlined hood line, an internal combustion engine for powering said vehicle transversely mounted in said forward compartment, a heat exchanger operatively connected to the engine mounted in said compartment, a cage type engine cooling fan mounted in parallel relationship to said engine, said cooling fan comprising a rotatable input drive shaft parallel to said engine, a pair of laterally spaced side plates drivingly secured to said input drive shaft, a plurality of variable pitch air pumping fan blades extending between said side plates and disposed radially outwardly of said input drive shaft, pivot means mounting said blades to said side plates, actuator means for turning said blades on associated axes extending through said pivot means thereby varying the pitch of said blades, and air directing shroud means disposed around said fan having a first opening therein for supplying inlet air thereto and having an outlet opening therein for discharging air from said fan, and mechanical drive means for drivingly connecting said engine to said input drive shaft of said fan for the rotational drive of said fan by said engine.

2. In an automotive vehicle, an internal combustion engine transversely mounted therein for powering said vehicle, rotatable cooling fan mounted adjacent to and in close parallel relationship to said engine, a heat exchanger adjacent to said fan operatively connected to the engine for receiving a flow of air therethrough induced by said rotating fan, said cooling fan comprising a rotatable input drive shaft, a pair of laterally spaced side plates drivingly secured to said input drive shaft, a plurality of air circulating fan blades operatively mounted by said side plates and disposed radially outwardly of and around said input drive shaft, pivot means mounting each of said blades to said side plates for limited angular movement about pivot axes disposed radially outwardly of said input shaft, air directing shroud means disposed around said fan blades forming an air inlet opening therein for directing inlet air into said fan and forming an air outlet opening for discharging air from said fan, and centrifugally responsive weight means operatively mounted on said fan and operatively connected to said blades for varying the pitch of said blades in proportion to the rotatable speed of said input shaft to thereby vary the volumetric air output of said fan.

3. In an automotive vehicle powered by an internal combustion engine, a transverse cooling fan for inducing a flow of air through an adjacent heat exchanger operatively connected to the engine, said transverse cooling fan comprising a rotatable input drive shaft, a pair of laterally spaced side plates drivingly secured to said input drive shaft, a plurality of air circulating fan blades extending between said side plates and disposed radially outwardly of said input drive shaft, pivot means mounting each of said blades to said side plate for limited angular movement about pivot axes disposed about said centralized input shaft, and air directing shroud means disposed around said fan blades having a first opening therein for supplying inlet air and having an outlet opening therein for discharging air from said fan, and centrifugally responsive weight means operatively mounted on said fan and operatively connected to said blades for varying the pitch of said blades in proportion to the rotatable speed of said input shaft to thereby vary the output of said fan.

* * * * *